US010772413B1

(12) United States Patent
Bacheller et al.

(10) Patent No.: US 10,772,413 B1
(45) Date of Patent: Sep. 15, 2020

(54) RECREATIONAL UTILITY SUPPORT

(71) Applicant: Harvey George LLC, Evans, GA (US)

(72) Inventors: Austin Bacheller, Evans, GA (US); Terri Bacheller, Evans, GA (US); John Bobbitt, III, Evans, GA (US)

(73) Assignee: Harvey George LLC, Evans, GA (US)

( * ) Notice: Subject to any disclaimer, the term of this patent is extended or adjusted under 35 U.S.C. 154(b) by 0 days.

(21) Appl. No.: 16/282,932

(22) Filed: Feb. 22, 2019

(51) Int. Cl.
*F16M 13/00* (2006.01)
*A45F 3/44* (2006.01)
*E04H 12/32* (2006.01)

(52) U.S. Cl.
CPC ..... *A45F 3/44* (2013.01); *E04H 12/32* (2013.01)

(58) Field of Classification Search
CPC ..... A45F 1/44; F16B 7/105; F21V 33/008
See application file for complete search history.

(56) References Cited

U.S. PATENT DOCUMENTS 10,077,893 B1 * 9/2018 Abraham ..... F21V 33/0052
2002/0166928 A1 * 11/2002 Johnson ..... A45F 3/44 248/125.3
2006/0060749 A1 * 3/2006 Dahlstrom ..... A45F 3/44 248/545
2013/0134279 A1 * 5/2013 Whittemore ..... E04G 21/26 248/354.1
2015/0197902 A1 * 7/2015 Yeghiayan ..... E04H 12/2215 248/545

* cited by examiner

*Primary Examiner* — Amy J. Sterling
(74) *Attorney, Agent, or Firm* — Taylor English Duma LLP

(57) ABSTRACT

A support utility includes a base comprising a drilling portion connected to a central portion and to a flange portion, the central portion defining a central bore therein; at least one elevating implement connected to the base; and, at least one utility implement connected to at least one elevating implement.

18 Claims, 9 Drawing Sheets

RECREATIONAL UTILITY SUPPORT

TECHNICAL FIELD

This disclosure relates to recreational utility apparatus. More specifically, this disclosure relates to utility supports.

BACKGROUND

It can be desirable to have outdoor gatherings at parks, beaches, forests, or other outdoor locations. In many such gatherings, it can be advantageous to elevate items above the ground, which may be sand, dirt, mud, gravel, or otherwise undesirable materials for certain belongings. However, many of these locations can be inaccessible, and the desire to elevate personal items may come in conflict with the ability to move an elevating apparatus to the desired location.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

A support utility includes a base comprising a drilling portion connected to a central portion and to a flange portion, the central portion defining a central bore; at least one elevating implement connected to the base; and, at least one utility implement connected to at least one elevating implement.

A method of using a support utility with ground includes obtaining a support utility, the support utility comprising a base comprising a drilling portion connected to a central portion and to a flange portion, the flange portion comprising a first end and a second end, each end defining a half-notch, the central portion defining a central bore; a plurality of elevating implements, at least one elevating implement connected to the base within the central bore and at least one end of one elevating implement connected to at least one end of at least one other elevating implement by a spring; and, at least one utility implement connected to at least one elevating implement, wherein each half-notch is sized to accept and to retain at least one elevating implement; engaging the drilling portion in contact with the ground such that at least part of the central portion contacts the ground; and arranging the elevating implements end-to-end such that at least a portion of one elevating implement overlaps at least a portion of at least one other elevating implement. Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
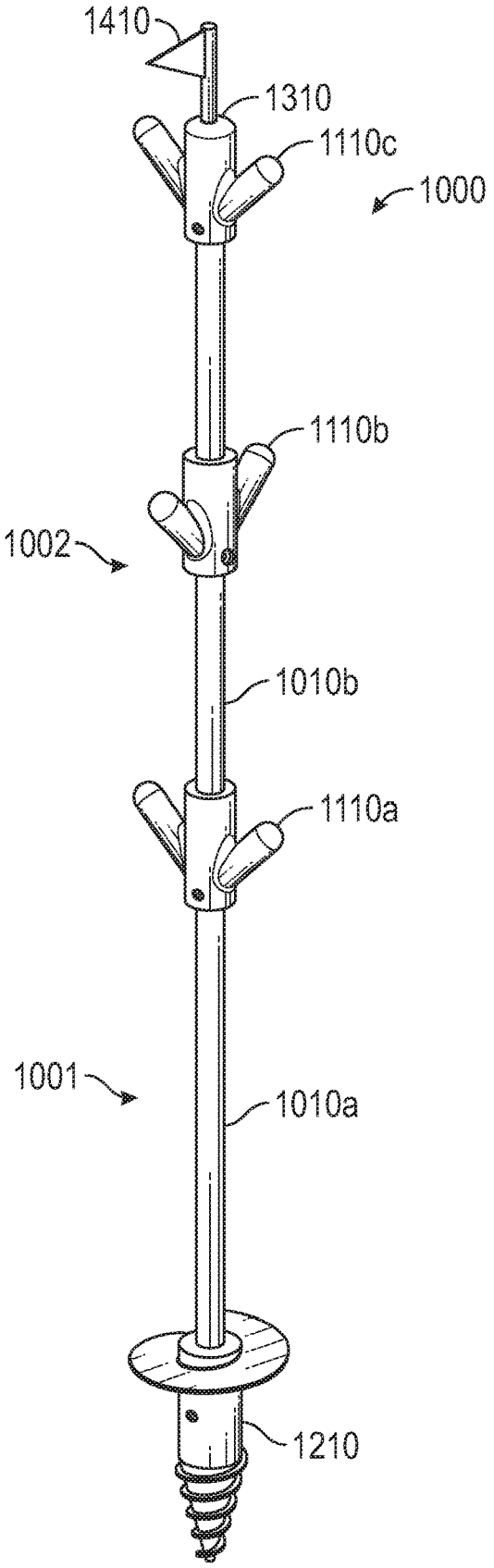
FIG. 1 is a perspective view of a support utility in accord with one aspect of the current disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a recreational support utility and associated methods, systems, devices, and various apparatus. It would be understood by one of skill in the art that the disclosed support is described in but a few exemplary embodiments among many. No particular terminology or description should be considered limiting on the disclosure or the scope of any claims issuing therefrom.

In one aspect of the current disclosure, a support assembly 1000 is disclosed and described with reference to FIG. 1. The support assembly 1000 can define a recreational support utility in accord with one aspect of the current disclosure. In various aspects, various constructions and arrangements of parts can be utilized, and no particular arrangement or construction should be considered limiting on the scope of the current disclosure. Although described as an assembly, the various parts of the current disclosure can be integrally formed without departing from the scope and purpose of the current disclosure. In the current aspect, the support assembly 1000 can comprise a lower or first subassembly 1001 and an upper or second subassembly 1002 connected to each other. The support assembly 1000 can comprise a plurality of elevating implements 1010*a*, 1010*b* and a plurality of utility implements 1110*a*, 1110*b*, 1110*c*. In various aspects, each elevating implement 1010*a*, 1010*b* can be separate and multiple parts, can be joined of multiple parts, or can be integrated. In the current aspect, each elevating implement 1010 can be a straight, hollow pole formed of metal, various plastics, wood, ceramic, or composite materials among others, including those described elsewhere in this disclosure for various parts. In the current aspect, the elevating implement 1010*a* can comprise a part of the first subassembly 1001 and the elevating implement 1010*b* can comprise a part of the second subassembly 1002. In various aspects the elevating implements can be various shapes, sizes, and constructions, including injection molded, solid, one-piece, multiple-piece, or various other constructions known in the art. In various aspects, the elevating implements can be curved, can be formed of multiple pieces, and/or can comprise tension elements. In various aspects, the utility implements 1110 can comprise various shapes, constructions, materials, and arrangements to achieve a desired function or to address desires of the support assembly 1000. Additional arrangements and constructions will be described in additional detail later in this disclosure. The support assembly 1000 of the current disclosure can comprise an anchor or base 1210. In the current aspect, the base 1210 can comprise features designed to anchor the support assembly 1000 within various conditions of turf, ground, sand, or various other surfaces or ground conditions as desired by a user. The support assembly 1000 of the current aspect can also comprise a cap 1310. The support assembly 1000 can also include additional attachments, such as an indicator apparatus, which in certain aspects can comprise a flag 1410. The arrangements of the various parts in the current aspect will be described in greater detail below.

Figure 2:
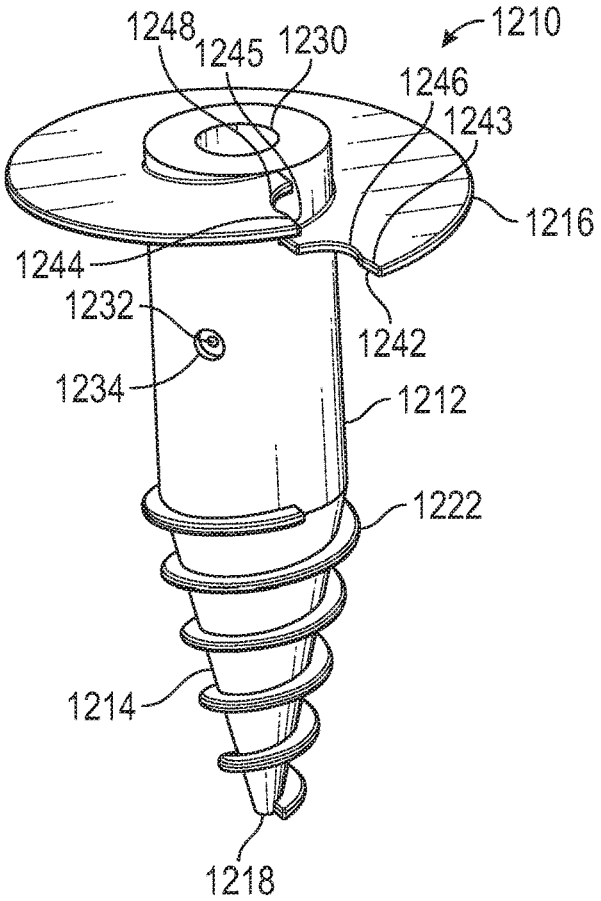
FIG. 2 is a perspective view of a base for use in the support utility of FIG. 1.

A view of the base 1210 can be seen with reference to FIG. 2. The base 1210 can comprise a central portion 1212, a drilling portion 1214, and a flange portion 1216. In the current aspect, the central portion 1212 can be cylindrical, the drilling portion 1214 can be conical in shape, and the flange portion 1216 can serve as a rim or edge to prevent unnecessary seating of the base 1210 when using the support assembly 1000. In the current aspect, the central portion 1212 can be located to provide a portion between the drilling portion 1214 and the flange portion 1216 so that the base 1210 can be properly anchored to the ground. Without the central portion 1212, the base 1210 could potentially not be dug deep enough into the ground when in use, or, in various applications, the central portion 1212 can provide a wall for dirt, sand, or other surface material to be anchored against.

A drilling flange 1222 can be located proximate to the drilling portion 1214. The drilling flange 1222 can be helical in shape and can be arranged to provide a drilling force on the base 1210 when the base 1210 is rotated. The drilling flange 1222 can be of a rectangular cross-section protruding helically from a side wall of the drilling portion 1214 in the current aspect. The drilling portion 1214 can terminate on one end proximate a tip end 1218 of the base 1210 and on the other end proximate the joint between the drilling portion 1214 and the central portion 1212. In the current aspect, the drilling flange 1222 can define a width that is wider than a diameter of the central portion 1212 such that the drilling action of the drilling portion 1214 can create a space in the ground larger than the central portion 1212, allowing the central portion 1212 to pass through the created space without needing additional leverage or screwing. In various aspects, the drilling flange 1222 can be pointed, textured, or angled with a different cross section than rectangular, including triangular, curved, or otherwise having an edge. In the current aspect, the shape of the drilling flange 1222 can be selected to accommodate the strength requirements necessary of the material chosen to form the base 1210. For example, in some aspects, the base 1210 can be made of injection-molded plastic such as ABS, Nylon, PC, PC/ABS, or PE plastics. In these cases, it can be advantageous to make the drilling flange 1222 of a relatively large width to provide added strength. In other aspects, the base 1210 can be formed of metal, composite, or other stronger materials, and, as such, different drilling flange 1222 shapes can be achieved without detracting from the strength of the design. In various aspects, the base 1210 can be of a hybrid of materials; for example, certain portions such as the drilling portion 1214 can be formed of injection-molded materials while the drilling flange 1222 can be formed of metal. Variations and combinations of the elements disclosed herein would be understood by one of skill in the art to be included within this disclosure.

A central bore 1230 can be defined within the central portion 1212. The central portion 1212 can be arranged for coupling of the elevating implement 1010*a*. A pinning bore 1232 can be defined in a side wall of the central portion 1212 to provide mechanical communication to the central bore 1230. The pinning bore 1232 can also comprise a countersink 1234.

The flange portion 1216 can comprise a first end 1242 and a second end 1244. The first end 1242 can define a half-notch 1246 and the second end 1244 can define a half-notch 1248. Each half-notch 1246, 1248 can be shaped to accept one of the elevating implements 1010*b*, for example, to allow the support assembly 1000 to be folded for ease of portability and storage. In the current aspect, each half-notch 1246,1248 can comprise a portion being about circular to accommodate the circular cross-section of the elevating implement 1010*b*, although in various aspects various shapes or mechanisms can be chose. The first end 1242 and the second end 1244 can also define a first capture ledge 1243 and a second capture ledge 1245, respectively. Each capture ledge 1243,1245 can be sized to capture the elevating implement 1010*b* first by allowing the elevating implement to pass through between the first end 1242 and the second end 1244 by elastic deformation of the capture ledges 1243, 1245 and second by holding the elevating implement 1010*b* securely behind the capture ledges 1243, 1245 until a user removes the elevating implement 1010*b*, usually by elastic deformation of the capture ledges 1243, 1245. In various aspects, one of skill in the art would understand that various securing mechanisms can be utilized to allow collapsing and storing of the support assembly 1000 without departing from the spirit of the disclosure. The half-notches 1246, 1248 and the capture ledges 1243, 1245 together can define a capture system. One of skill in the art would understand that systems to capture the elevating implement 1010*b* and to allow portability of the support assembly 1000 can comprise multiple different approaches that are known in the art, and no single implementation of a capture system should be considered limiting on the scope of the current disclosure.

In the current aspect, the first end 1242 can be arranged in physical space at a lower location than the second end 1244. The arrangement can allow some anchoring of the flange portion 1216 into ground if desired by the user. The flange portion 1216 can be arranged in a helical arrangement around the central portion 1212 with about constant cross-sectional shape. In the current aspect, the flange portion 1216 can have a rectangular cross section, the cross-section having a width in a radial dimension substantially greater than a thickness in the vertical direction. As such, the flange portion 1216 can provide a lightweight but effective barrier against over-seating—or, in other words, digging too deep—of the base 1210. In various aspects, the flange portion 1216 can be a disc. In such aspects, the flange portion 1216 can be prevented from screwing into ground by its arrangement.

Figure 3:
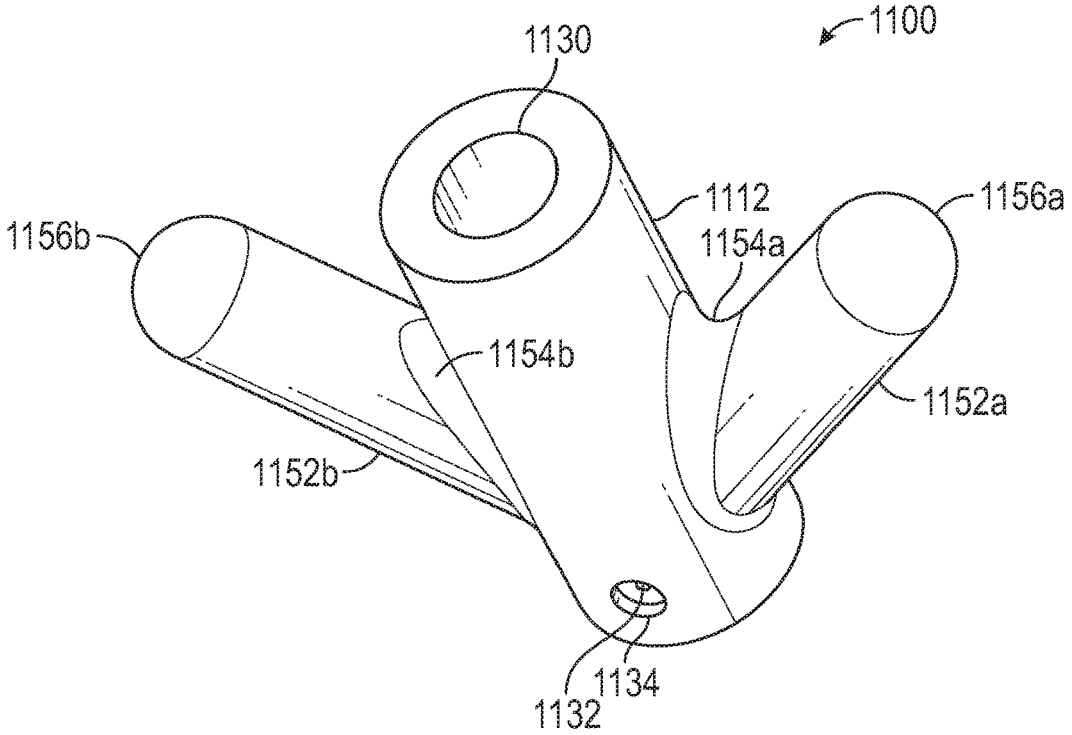
FIG. 3 is a perspective view of a utility implement for use in the support utility of FIG. 1.

One example of the utility implement 1110 in accord with one aspect of the current disclosure can be seen with reference to FIG. 3. The utility implement 1110 in the current aspect can address one of many different possible functions. One of skill in the art would understand that the specific implementation of the utility implement 1110 shown and described is not intended to be limiting on the scope of the current disclosure.

The utility implement 1110 can comprise a central portion 1112 generally arranged for coupling to at least one of the elevating implements 1010. In the current aspect, the central portion 1112 can be cylindrical in shape and can define a central bore 1130 for acceptance of one elevating implement 1010, which in the current aspect can be a bar or rod of circular cross-section. A pinning bore 1132 can be defined in a side wall of the central portion 1112 to provide mechanical communication to the central bore 1130. The pinning bore 1132 can also comprise a countersink 1134. The utility implement 1110 can comprise a plurality of utility arms 1152*a*, 1152*b* extending from the central portion 1112. In various aspects, the number of utility arms 1152 can be variant; in some aspects, one utility arm 1152 can be utilized, while in various aspects three, four, five, six, or more utility arms 1152 can be utilized without departing from the scope of the disclosure. In the current aspect, each utility arm 1152*a*, 1152*b* can be arranged at an angle with respect to the central portion 1112 such that each utility arm 1152*a*, 1152*b* can be generally described as tilting upwards. As such, each utility arm 1152*a*, 1152*b* can define a hook shape to allow items or objects to hang.

Each utility arm 1152*a*, 1152*b* can define a shoulder 1154*a*, 1154*b* that can define a lowest contact point of the hook shape. In various aspects, the shoulder 1154*a*, 1154*b* can be tasked with holding the bulk of load applied to each utility arm 1152*a*, 1152*b*. In various aspects, the shoulder 1154*a*, 1154*b* can also define a location of highest stress and strain concentration and/or a location of highest mechanical moment, depending on the application, and, as such, can, in some aspects, define a point of needed strength for the support assembly 1000. In the current aspect, each utility arm 1152*a*, 1152*b* can define an end 1156*a*, 1156*b* that can define the termination of the utility arm 1152*a*, 1152*b* in space. In the current aspect, each utility arm 1152*a*, 1152*b* can be arranged extending upwardly at about a 45° angle with respect to the central portion 1112. In various aspects, sharper or wider angles can be more desirable, depending on the application. For example, in certain applications—such as when the weight supported is expected to be high—a narrower angle can be useful between the central portion and the utility arms 1152, such as 30°. In other applications—such as when the items supported are expected to be especially large but not particularly heavy—a wider angle can be useful between the central portion and the utility arms 1152, such as 60°. In various aspects, other shapes of utility arms 1152 can be utilized, including bends, curves, elbows, and forks. In various aspects, multiple styles of utility arms 1152 can be utilized in the same design. In the current aspect, each utility arm 1152 can be generally cylindrical in shape.

In the current aspect, each utility implement 1110 can be injection-molded plastic such as ABS, Nylon, PC, PC/ABS, or PE plastics, among others. In various aspects, utility implements 1110 can be other types of plastics, various metals, ceramics, wood, or other materials described elsewhere in this disclosure for the various parts described herein.

Figure 4:
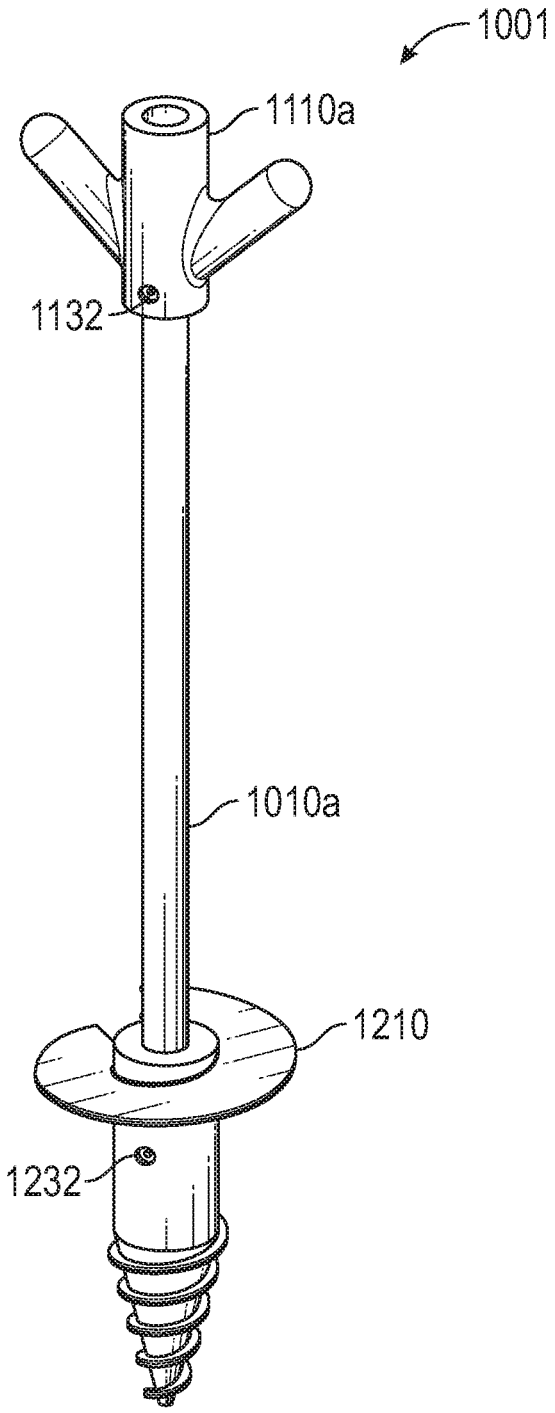
FIG. 4 is a perspective view of a first subassembly of the support utility of FIG. 1.

The first or lower subassembly 1001 can be seen with reference to FIG. 4. As can be seen, the base 1210 can be combined with the elevating implement 1010*a* and at least one utility implement 1110. The base 1210 and the utility implement 1110 can be affixed or adhered to the elevating implement 1010*a* using adhesives, key/fit arrangements, threading, or various other securing mechanisms as known in the art. In the current aspect, the base 1210 and the utility implement 1110 can be connected to the elevating implement 1010*a*, using a pin arrangement. A pin (not shown) can be inserted through each of the pinning bore 1132 and the pinning bore 1232 and through a crossing bore defined in the elevating implement 1010*a*. By pinning through the elevating implement 1010*a*, each of the utility implement 1110 and the base 1210 can become securely fastened to the elevating implement 1010*a*. In practice, the pin (not shown) can be a rivet, a screw, a bolt and nut combination, or various other mechanisms of affixing the elevating implement 1010*a* in space with reference to each of the base 1210 and each utility implement 1110.

Figure 5:
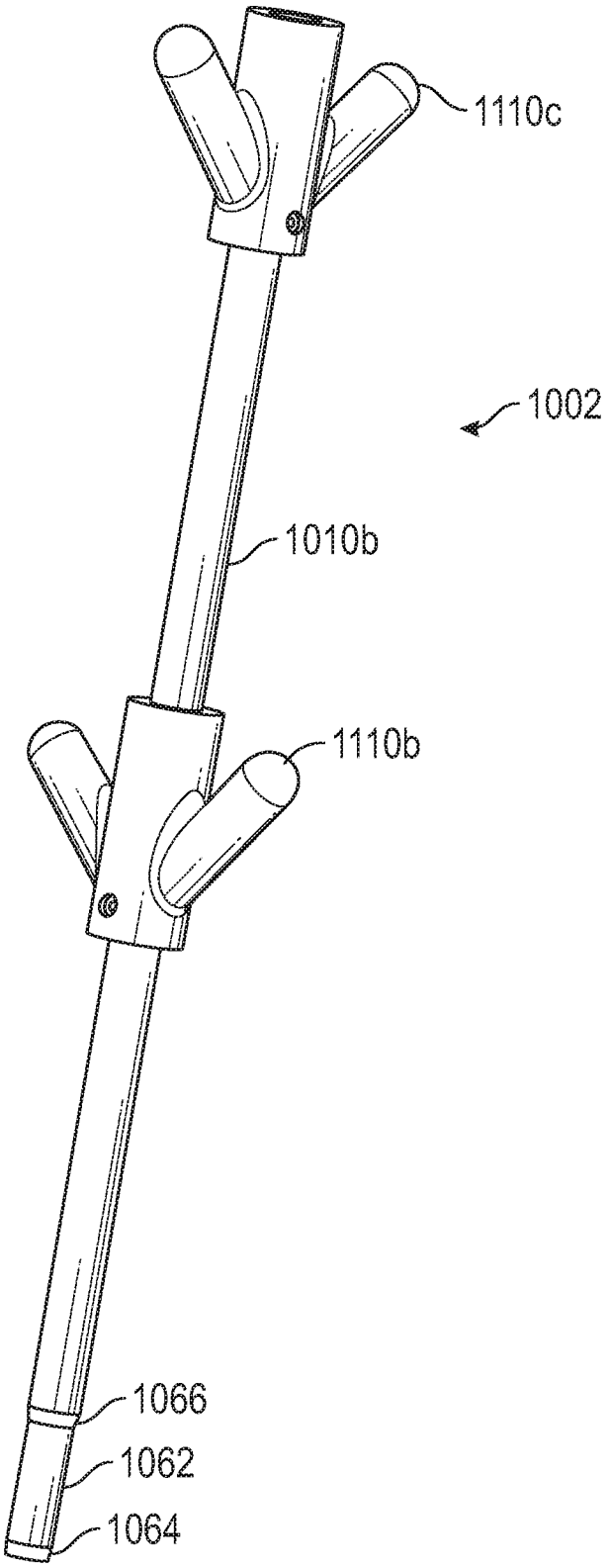
FIG. 5 is a perspective view of a second subassembly of the support utility of FIG. 1.

The second or upper subassembly 1002 can be seen with reference to FIG. 5. As can be seen, the elevating implement 1010*b* can be similar in size and shape to the elevating implement 1010*a*. However, in the current aspect, the elevating implement 1010*b* can comprise a nesting region 1062 that can define one end of the elevating implement 1010*b*. In the current aspect, the nesting region 1062 can comprise an outer wall diameter that is smaller than an inner wall diameter of the elevating implement 1010*a*. As such, the nesting region 1062 can be inserted into the elevating implement 1010*a* to provide a joint between the first subassembly 1001 and the second subassembly 1002. As can be seen, the nesting region 1062 can define a tapered end 1064 of the elevating implement 1010*b*, which can help with insertion of the nesting region 1062 into the elevating implement 1010*a*.

Additionally, the nesting region 1062 can be defined from the remaining portions of the elevating implement 1010*b* such that the nesting region 1062 can be formed integrally with or attached to the remainder of the elevating implement 1010*b*. As seen in the current aspect, the remainder of the elevating implement 1010*b* can have a profile similar to the elevating implement 1010*a* such that the two elevating implements 1010*a*, 1010*b* substantially match each other. In various aspects, the elevating implement 1010*b* can have a diameter similar to the elevating implement 1010*a*. Therefore, the nesting region 1062 can be defined inwardly from the elevating implement 1010*b*, as can be seen. The nesting region 1062 can thereby define a nesting shoulder 1066 that can serve as a transitional region between the nesting region 1062 and the remainder of the elevating implement 1010*b*. In various aspects, similar functioning can be achieved by defining the nesting region 1062 of a greater inner diameter than the outer diameter of the elevating implement 1010*a* such that the nesting region 1062 can secure to an outside of the elevating implement 1010*a*.

In various aspects, various fasteners such as screws, threading, key/fit arrangements, or various other mechanical fasteners known in the art can be employed to connect the elevating implements 1010*a*, 1010*b* together. In the current aspect, the elevating implement 1010*a* can be connected to the elevating implement 1010*b* by an internal spring. In various aspects, the internal spring can be a helical spring, a bungee cord, a leaf spring, or various other recoil apparatus as would be known to one of skill in the art. In the current aspect, the internal spring can bias the two subassemblies 1001, 1002 into connection with one another. The subassemblies 1001, 1002 can be collapsed by a user overcoming the spring force to separate the elevating implement 1010*a* from the elevating implement 1010*b* such that the nesting region 1062 can be removed from the end of the elevating implement 1010*a*. Although the subassemblies 1001, 1002 can remain connected, the support assembly 1000 can be collapsed for easy of carrying and storage.

Figure 6:
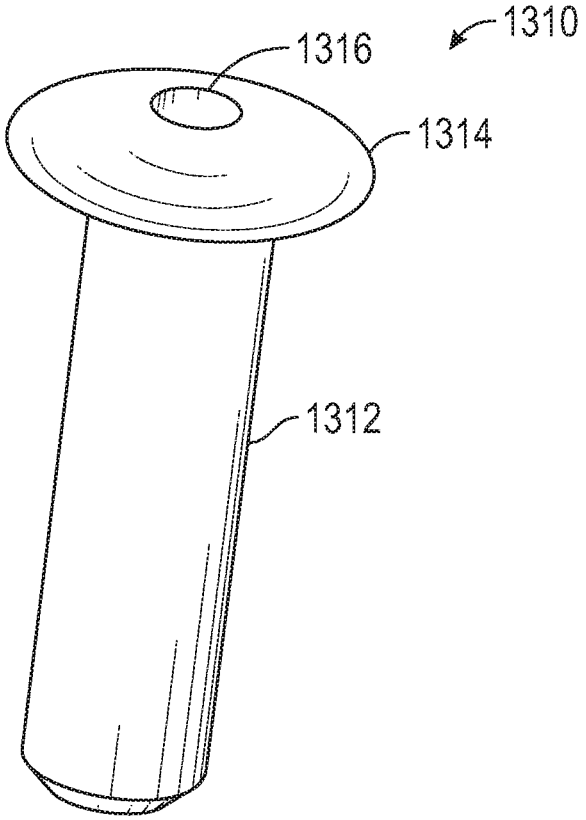
FIG. 6 is a perspective view of a cap for use in the support utility of FIG. 1.

As can be seen with returning reference to FIG. 1, the cap 1310 can be provided above the elevating implement 1010—in the current aspect, specifically above the elevating implement 1010*b*—to provide a cover to the elevating implement 1010 and to prevent debris and other materials from becoming introduced into the center of the elevating implement 1010 when it is hollow. The cap 1310 can be seen in greater detail with reference to FIG. 6. The cap 1310 can be made of rubber, plastic, or various other materials. The cap 1310 can comprise a body 1312 that can be sized to be inserted into the elevating implement 1010. The cap 1310 can comprise a head 1314 that can extend above the elevating implement 1010 to provide the cover and to provide a stop at the end of the elevating implement 1010. The head 1314 can define a bore 1316 in various aspects. In various aspects, the bore 1316 can be used for additional attachment of further apparatus, such as the flag 1410, or various other indicator as one might utilize, including lights, screens, or other connections. In various aspects, the flag 1410 can be various colors, shapes, and sizes or can include various indicia, such as sporting team logos, collegiate logos, or various other identifiers. The flag 1410 can be especially useful for identifying groups within crowded locations. For example, at a party location or at a crowded beach, a group can identify using specific color combination that can make members of the party easier to find. Other examples of further apparatus that can be utilized in place of the flag 1410 can include an umbrella for sun or rain protection, a tent pole or support, or a hook for elevated storage, among others. In various aspects, the bore 1316 can be threaded or otherwise mechanically arranged to accept or to couple to the apparatus (such as the flag 1410). The additional apparatus (such as flag 1410) can also be threaded, pinned, or otherwise mechanically arranged to couple to the bore 1316.

Figure 7:
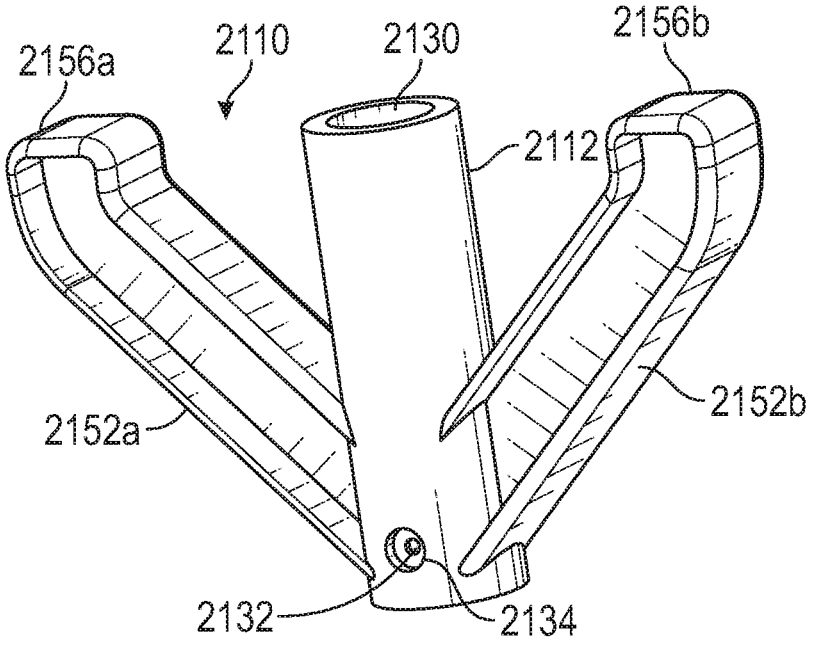
FIG. 7 is a perspective view of an alternative aspect of a utility implement for use in the support utility of FIG. 1.

Another aspect of a utility implement 2110 can be seen with reference to FIG. 7. The utility implement 2110 can comprise a central portion 2112 generally arranged for coupling to at least one of the elevating implements 1010 similar to the coupling of utility implement 1110. In the current aspect, the central portion 2112 can be cylindrical in shape and can define a central bore 2130 for acceptance of one elevating implement 1010, which in the current aspect can be a bar or rod of circular cross-section. A pinning bore 2132 can be defined in a side wall of the central portion 2112 to provide mechanical communication to the central bore 2130. The pinning bore 2132 can also comprise a countersink 2134. The utility implement 2110 can comprise a plurality of utility arms 2152*a*, 2152*b* extending from the central portion 2112. In various aspects, the number of utility arms 2152 can be variant; in some aspects, one utility arm 2152 can be utilized, while in various aspects three, four, five, six, or more utility arms 2152 can be utilized without departing from the scope of the disclosure.

In the current aspect, each utility arm 2152*a*, 2152*b* can be arranged at an angle with respect to the central portion 2112 such that each utility arm 2152*a*, 2152*b* can be generally described as tilting upwards. As such, each utility arm 2152*a*, 2152*b* can define a hook shape to allow items or objects to hang. In the current aspect, each utility arm 2152*a*, 2152*b* can define an end 2156*a*, 2156*b* that can define the termination of the utility arm 2152*a*, 2152*b* in space. In the current aspect, each utility arm 2152*a*, 2152*b* can be arranged extending upwardly at about a 45° angle with respect to the central portion 2112. Each end 2156*a*, 2156*b* can be provide a slight upward tilt to emphasize the hook shape of the utility arm 2152*a*, 2152*b*. In various aspects, sharper or wider angles can be more desirable, depending on application. For example, in certain applications—such as when the weight supported is expected to be high—a narrower angle can be useful between the central portion and the utility arms 2152, such as 30°. In other applications—such as when the items supported are expected to be especially large but not particularly heavy—a wider angle can be useful between the central portion and the utility arms 2152, such as 60°. In various aspects, other shapes of utility arms 2152 can be utilized, including bends, curves, elbows, and forks. In various aspects, multiple styles of utility arms 2152 can be utilized in the same design. In the current aspect, each utility arm 2152 can be substantially hollow in shape and can be substantially outlined. Each utility arm 2152 can be substantially branch-shaped, having little material in the center and increasing material along the ends to bolster strength and surface area. In the current aspect, each utility implement 2110 can be injection-molded plastic such as ABS, Nylon, PC, PC/ABS, or PE plastics, among others. In various aspects, utility implements 2110 can be other types of plastics, various metals, ceramics, wood, or other materials described elsewhere in this disclosure for the various parts described herein.

Figure 8A:
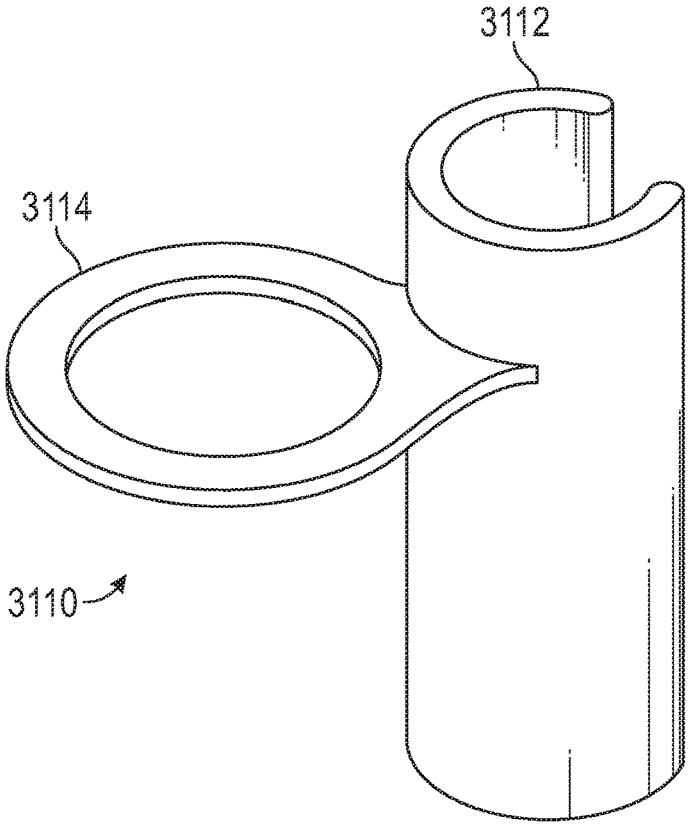
FIG. 8A is a perspective view of an alternative aspect of a utility implement for use in the support utility of FIG. 1.
Figure 8B:
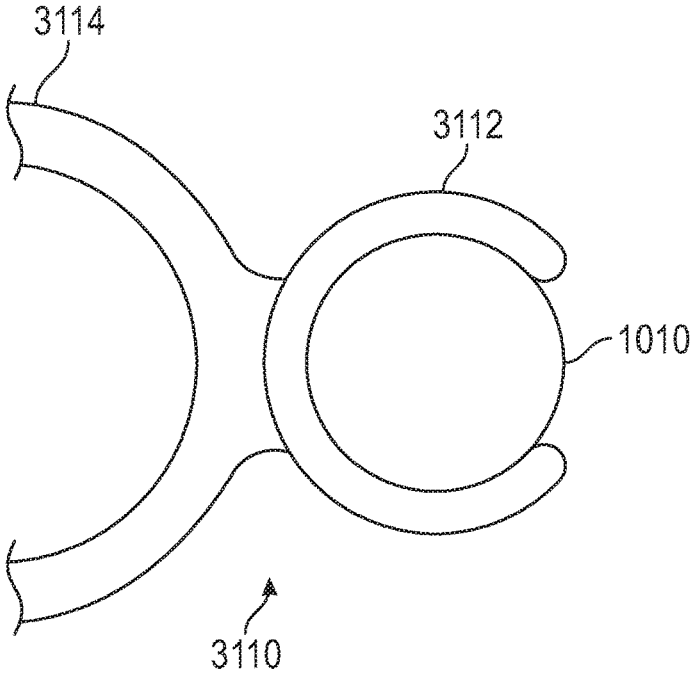
FIG. 8B is a top view of the utility implement of FIG. 8A as attached to the support utility of FIG. 1.
Figure 9:
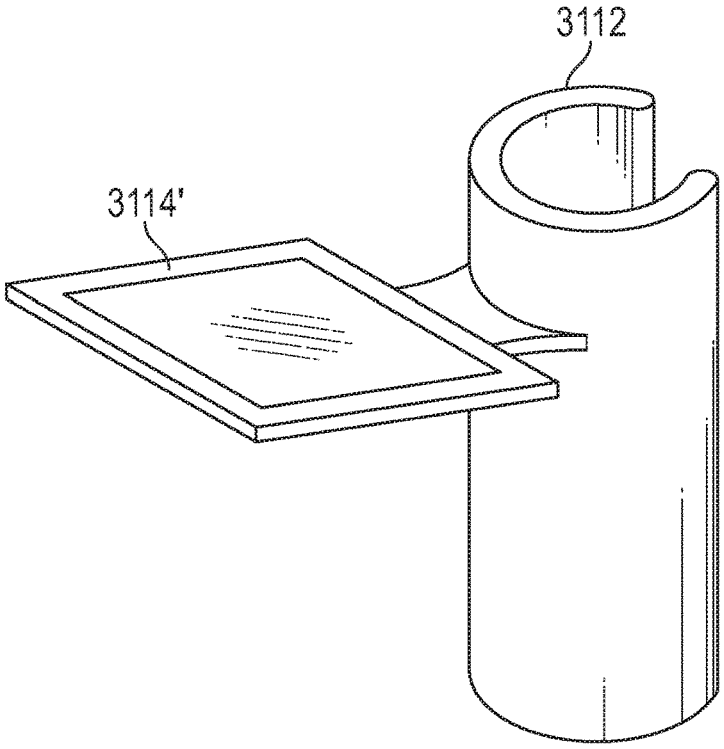
FIG. 9 is a perspective view of an alternative aspect of a utility implement for use in the support utility of FIG. 1.

Another aspect of a utility implement 3110 can be seen with reference to FIG. 8A-8B. In the current aspect, the utility implement 3110 can be of the snap-on or slip-on variety. In various aspects, the utility implement 3110 can interact with the elevating implement 1010 by friction. In various aspects, the utility implement 3110 can connect to the elevating implement 1010 using notches or various mechanical interactions. The utility implement 3110 can comprise a body sleeve portion 3112 for attachment to the elevating implement 1010 and a utility portion 3114 connected to or integral with the body sleeve portion 3112. The body sleeve portion 3112 can be of a ductile but strong material such that the body sleeve portion 3112 can be elastically deformed around the elevating implement 1010 and can be attached to the elevating implement 1010 by snapping on or otherwise fitting over the elevating implement 1010. The utility portion 3114 can comprise a variety of useful arrangements, including those already disclosed herein. In the currently displayed aspect, the utility portion 3114 can comprise a ring, such as a cup holder, umbrella holder, or a place for a support to be anchored or inserted. In various aspects, various shapes can be included as disclosed herein. As seen with reference to FIG. 9, in various aspects, a varied utility portion 3114' can comprise a shelf or pocket such that objects can be placed on or attached to the utility portion 3114'. Such utility portion 3114' can be useful for storing items that need constant access, such as a mobile phone. In various aspects, the shelf of utility portion 3114' can be arranged perpendicularly to the sleeve portion 3112 such as to remain about flat when assembled. In various aspects, rubber or other gripping surface application can be applied to the surface of the utility portion 3114' to prevent sliding of items placed thereon.

Figure 10A:
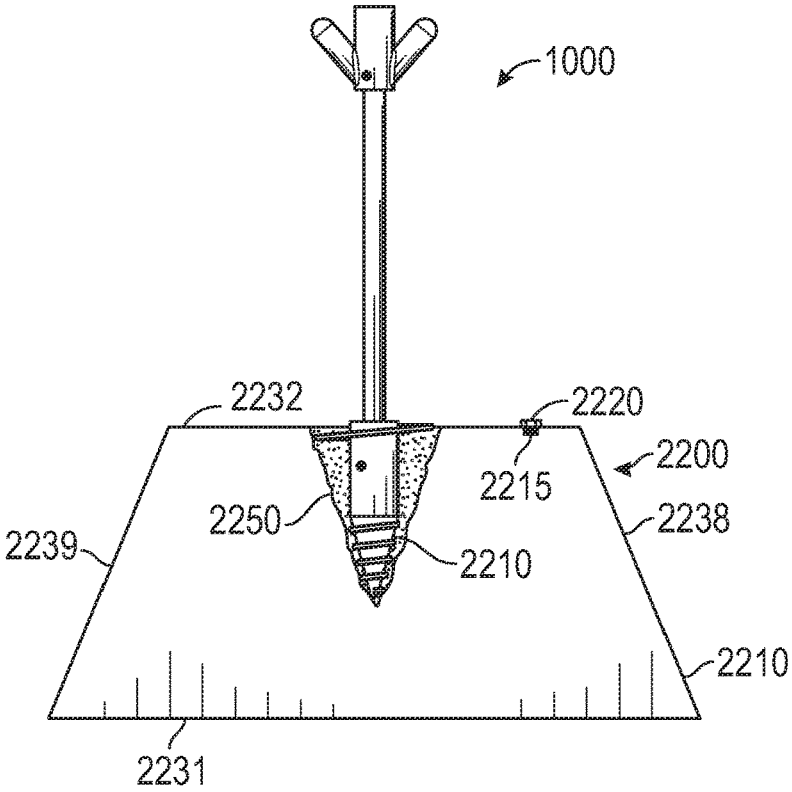
FIG. 10A is a side cross-sectional view of a stand for use with the support utility of FIG. 1.
Figure 10B:
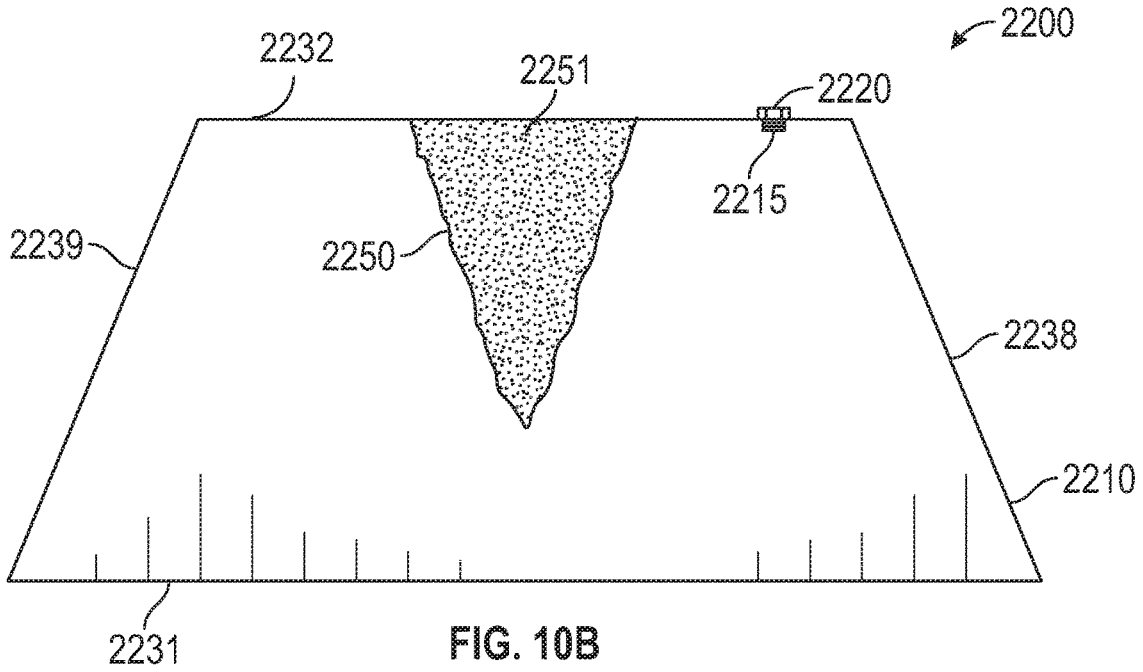
FIG. 10B is a side cross-sectional view of the stand of FIG. 10A without the support utility.
Figure 10C:
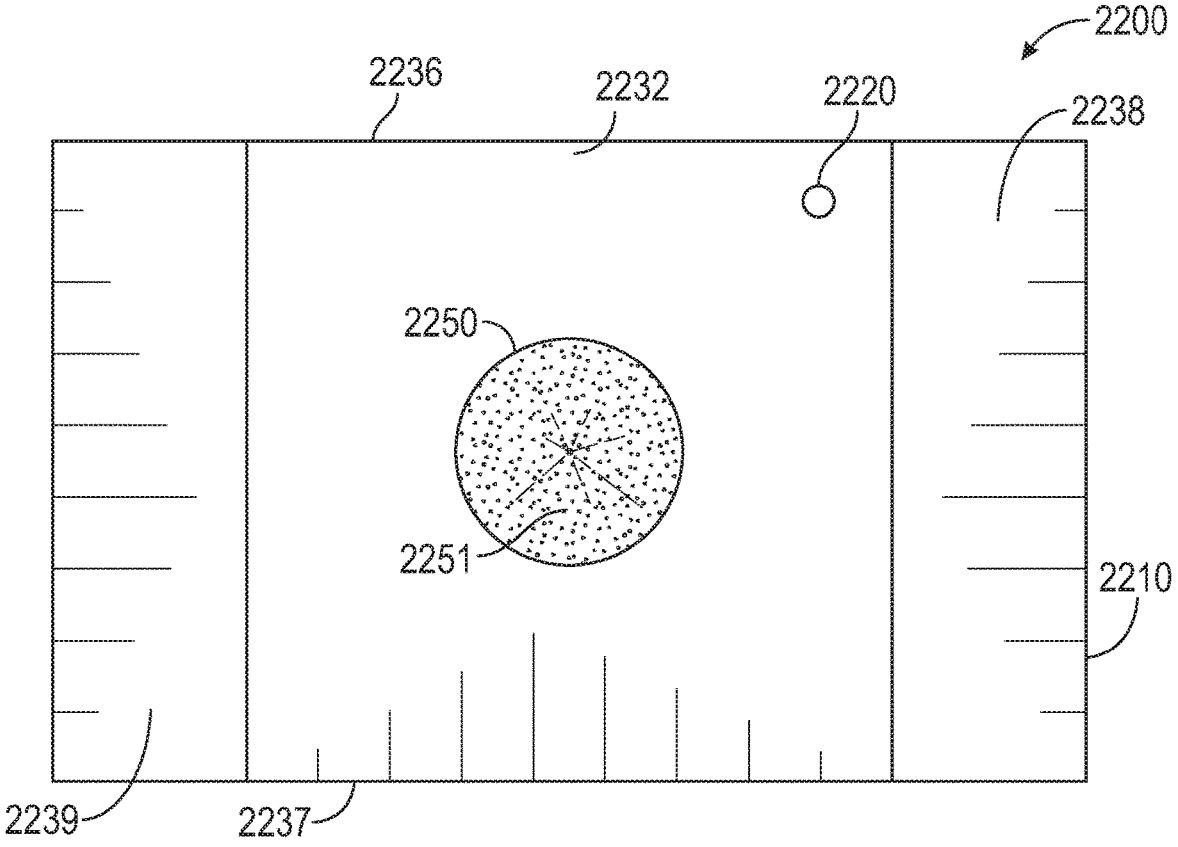
FIG. 10C is a top view of the stand of FIG. 10A.

As seen with reference to FIGS. 10A-10C, a stand 2200 can be utilized with the support utility 1000 to allow use of the support utility 1000 in ground conditions that are not anchorable or not easily penetrable, including concrete, stone, ice, hardpan, indoors, or other conditions that would be unlikely to allow the support utility 1000 to be anchored successfully. In various aspects, the stand 2200 can comprise a stand body 2210 that can be formed of various materials, including molded plastic, wood, sheet metal, composite, foam, or various other board or materials as are known in the art. In various aspects, the stand body 2210 can be hollow, such as from forming by blow-molded plastic or by forming from fiberboard or other wood board structure. In various aspects, the stand body 2210 can be solid, such as from forming by injection molded plastic or by foam. In various aspects, the stand body 2210 can be partially hollow. In cases where the stand body 2210 is hollow, the stand body 2210 can define an access port 2215 that can be included to provide access to the inside of the stand body 2210. An access port cap 2220 can be included to cover the access port 2215. The access port cap 2220 can be a snap-on, screw-on, bolt-on, or various other mechanical arrangements known in the art that can provide access to the interior of the stand body 2210. When the stand body 2210 is hollow, it can be of advantage to fill the stand body 2210 with a heavy material such as fluid (water), fluid-like materials (sand, gravel) or solid (rocks, wood), among others, to provide mass to stabilize the interaction of the support utility 1000 with the stand 2200. The access port 2215 can allow the stand body 2210 to be filled as desired. In various aspects, the stand body 2210 can comprise a drain port (not shown) to allow draining of fluid material or fluid-like material as needed.

In various aspects, the benefits of adding weight to the stand body 2210 can be obviated by a wide footprint. As can be seen, the stand body 2210 can comprise a bottom 2231, a top 2232 that can be of a smaller footprint than the bottom 2231, and four sides 2236, 2237, 2238, 2239. In the current aspect, the sides 2238,2239 can be angled such that the bottom 2231 can have a smaller footprint than the top 2232 and such that the cross-sectional view of the stand 2200 can be of a trapezoid. In the current aspect, each side is rectangular, although in various aspects, advantages can be achieved through use of a square bottom 2231. Although one shape of stand body 2210 can be seen, it would be understood by one of skill in the art that the shape shown is not limiting on the scope of the disclosure, and various shapes and sizes of stand bodies can be utilized successfully within the scope of the current disclosure.

The stand body 2210 can define a port 2250 defined in the top 2232. The port 2250 can be sized and shaped to accommodate the base 1210. The port 2250 can define an inner surface 2251 that in various aspects can be threaded, roughened, or can comprise a gripping material (such as rubber, foam, or Velcro) to prevent unintentional removal of the support utility 1000 from the stand 2200. In various aspects, various ledges and threading interactions can be defined along the port 2250 to capture the base 1210 and to secure the support utility therein.

In various aspects, the stand 2200 can be integral with or connected to the elevating implement 1010 such as to omit or to integrate with the base 1210. In various aspects, the stand 2200 can be a casting or molding of metal with substantial weight to provide ballast for the support utility 1000.

Figure 11A:
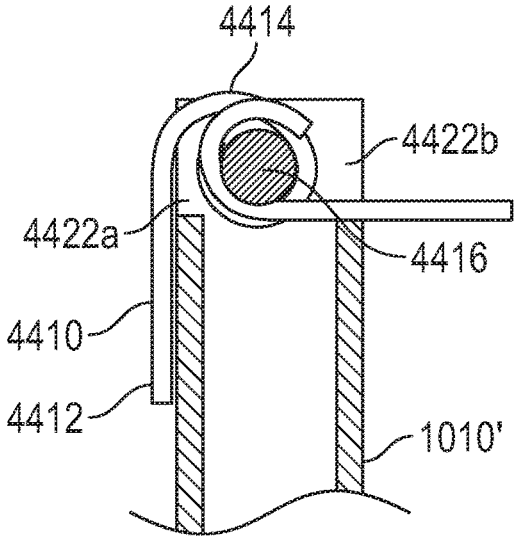
FIG. 11A is a cross-sectional view of one aspect of an indicator apparatus implemented into one aspect of the support utility of FIG. 1.
Figure 11B:
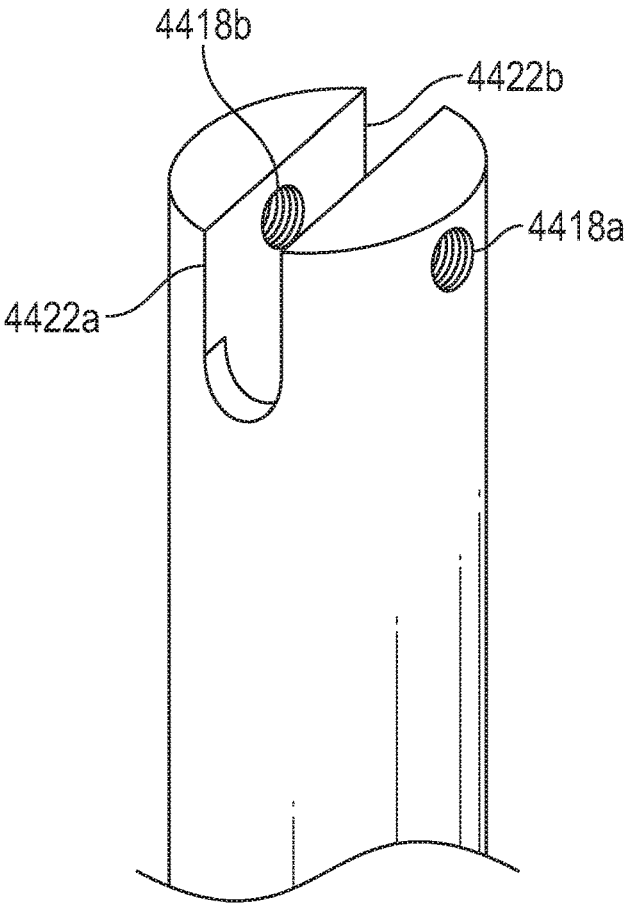
FIG. 11B is a perspective view of an elevating implement arranged for use with the indicator apparatus of FIG. 11A.

Additional mechanisms for indicator apparatus can be utilized within the scope of the current disclosure. With reference to FIGS. 11A-11B, an indicator apparatus or flag implement 4410 to hold a flag can be attached to a modified elevating implement 1010'. In the current aspect, the flag implement 4410 can comprise a flag holding end 4412 and a rotation end 4414, wherein the rotation end can be arranged to rotate within a channel along a pin 4416. The pin 4416 can be attached fixedly or removably to the elevating implement 1010'. The flag implement 4410 can be arranged such that the flag holding end 4412 can be about flush with an exterior of the elevating implement 1010' in a closed or collapsed arrangement and can extend perpendicularly to the elevating implement 1010' when in an opened or extended arrangement. As seen with specific reference to FIG. 11B, the pin 4416 (not shown in FIG. 11B) can connected within a pair of fastener holes 4418*a,b* defined in the elevating implement 1010'. As such, when connected, the pin 4416 can suspend the flag implement 4410. Support channels 4422*a,b* can be defined in sides of the elevating implement 1010' to interact with the flag implement 4410.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A support utility comprising:

a base comprising a drilling portion connected to a central portion and to a flange portion, the central portion defining a central bore;

at least one elevating implement connected to the base; and, at least one utility implement connected to at least one elevating implement, wherein the at least one elevating implement comprises a straight bar, wherein at least one elevating implement is connected to the base within the central bore, wherein at least one elevating implement comprises a hollow bar, wherein the at least one elevating implement comprises a plurality of elevating implements, each elevating implement comprising a hollow bar, and wherein an end of at least one elevating implement is connected to an end of at least one other elevating implement, wherein the plurality of elevating implements are connected together by a spring, wherein the at least one utility implement comprises a plurality of utility implements that are connected to at least one of the elevating implements, wherein at least one elevating implement is connected to at least one other elevating implement by a nesting region of at least one elevating implement being coupled to at least one other elevating implement, wherein each utility implement comprises a plurality of utility arms, wherein each utility arm is arranged at a 45° angle with respect to a central portion of the utility implement, wherein an indicator apparatus is connected to an end of the elevating implement, wherein the indicator apparatus is a flag, wherein the flange comprises a first end and a second end, wherein each end defines a half-notch, wherein each half-notch is sized to accept at least one elevating implement.

2. The support utility of claim 1, wherein a drilling flange protrudes from the drilling portion, the drilling flange being of rectangular cross-section and in helical arrangement about the drilling portion.

3. The support utility of claim 2, wherein at least one of the base, the elevating implements, and the utility implements are formed of plastic.

4. The support utility of claim 2, further comprising a stand, the stand comprising a bottom portion adapted for interaction with the ground and a top portion adapted for interaction with the base, the top portion defining a port for receiving at least a portion of the base.

5. A support utility comprising:

a base comprising a drilling portion connected to a central portion and to a flange portion, the central portion defining a central bore;

at least one elevating implement connected to the base; and, at least one utility implement connected to at least one elevating implement, wherein the flange comprises a first end and a second end, wherein each end defines a half-notch, wherein each half-notch is sized to accept at least one elevating implement.

6. The support utility of claim 5, wherein the at least one elevating implement comprises a straight bar, wherein at least one elevating implement is connected to the base within the central bore.

7. The support utility of claim 5, wherein the at least one elevating implement comprises a hollow bar.

8. The support utility of claim 5, wherein the at least one elevating implement comprises a plurality of elevating implements, each elevating implement comprising a hollow bar, and wherein an end of at least one elevating implement is connected to an end of at least one other elevating implement.

9. The support utility of claim 8, wherein the plurality of elevating implements are connected together by a spring.

10. The support utility of claim 9, wherein the at least one utility implement comprises a plurality of utility implements that are connected to at least one of the elevating implements.

11. The support utility of claim 10, wherein at least one elevating implement is connected to at least one other elevating implement by a nesting region of at least one elevating implement being coupled to at least one other elevating implement.

12. The support utility of claim 5, wherein each utility implement comprises a plurality of utility arms.

13. The support utility of claim 12, wherein each utility arm is arranged at a 45° angle with respect to a central portion of the utility implement.

14. The support utility of claim 5, wherein an indicator apparatus is connected to an end of the elevating implement.

15. The support utility of claim 14, wherein the indicator apparatus is a flag.

16. The support utility of claim 5, wherein a drilling flange protrudes from the drilling portion, the drilling flange being of rectangular cross-section and in helical arrangement about the drilling portion.

17. The support utility of claim 5, wherein at least one of the base, the elevating implements, and the utility implements are formed of plastic.

18. The support utility of claim 5, further comprising a stand, the stand comprising a bottom portion adapted for interaction with the ground and a top portion adapted for interaction with the base, the top portion defining a port for receiving at least a portion of the base.

* * * * *